US005746257A

United States Patent [19]

Fry

[11] Patent Number: 5,746,257

[45] Date of Patent: May 5, 1998

[54] CORRUGATOR BELT SEAM

[75] Inventor: Ted J. Fry, Summerville, S.C.

[73] Assignee: Asten, Inc., Charleston, S.C.

[21] Appl. No.: 668,247

[22] Filed: Jun. 21, 1996

Related U.S. Application Data

[60] Provisional application No. 60/000,917 Jul. 6, 1995.

[51] Int. Cl.[6] ..... D03D 13/00; D03D 15/00

[52] U.S. Cl. ..... 139/383 AA; 162/348; 162/904; 428/222; 428/223

[58] Field of Search ..... 139/383 AA; 162/348, 162/200, 358, 904; 428/57, 222, 223

[56] References Cited

U.S. PATENT DOCUMENTS

| | | | |
|---|---|---|---|
| 4,344,209 | 8/1982 | Harwood | 139/383 AA |
| 4,364,421 | 12/1982 | Martin . | |
| 4,574,435 | 3/1986 | Luciano et al. | 139/383 AA |
| 5,050,646 | 9/1991 | Fry . | |
| 5,488,976 | 2/1996 | Lorenz et al. | 139/383 AA |

*Primary Examiner*—Andy Falik

*Attorney, Agent, or Firm*—Volpe and Koenig, PC

[57] ABSTRACT

An all synthetic corrugator belt seam for joining corrugator belt sections constructed of a multi-layer fabric wherein each of the ends of the fabric is separated by removing intermediate CMD and MD yarns to form separated upper and lower fabric end portions and securing a seam tape between the separated layers at each end of the belting. The seam tape is sandwiched between the separated layers and completely enclosed therein when the layers and seam tape are secured together so that interruption of the otherwise continuous belting is minimized.

11 Claims, 3 Drawing Sheets

CORRUGATOR BELT SEAM

This application claims priority from U.S. Provisional Application Ser. No. 60/000,917, filed Jul. 6, 1995.

BACKGROUND OF THE INVENTION

1. Field of the Invention

The present invention relates to an all synthetic corrugator belt seam for joining a two warp layer corrugated belt fabric.

2. Description of the Prior Art

After a paper sheet is made by the conventional forming, pressing and drying operations, additional papermaking equipment can be used to manufacture corrugated material such as corrugated cardboard. In preliminary papermaking steps, a papermakers fabric is employed to transport the paper product during its manufacture. A corrugation machine combines separate paper sheets with an adhesive to form the corrugated paper product. On the corrugator machine, a corrugator fabric belt transports the paper products.

Corrugator machine fabric belts are typically rendered endless by connecting the ends of the belts with metal hooks. However, metal hooks can pull out of the fabric due to wear or stress fatigue. Wear on the interior surfaces of metal hooks can result in hook failure at the radius. This wear is due to the interior surface of the hook radius rubbing on the joining wire surface, which can also cause the joining wire to fail.

The metal hooks of many prior art seams are covered by a hood made from the fabric itself. This hood is frequently worn away, exposing the board to the hooks, frequently resulting in marking of the board. It is desirable to use synthetic coils which are more pliable and shock absorbent than metal hooks which reduces marking tendencies from roll bounce.

Connecting belts with metal hooks also results in creating an undesirable ridge at the seam. This may result in marking of the paper products and also results in additional wear and tear on the corrugator machine.

SUMMARY OF THE INVENTION

The present invention provides a woven corrugator belt and seam for joining opposing ends of the corrugator belt comprising a multi-layer system of cross machine direction (MD) yarns including upper CMD yarns, lower CMD yarns and intermediate CMD yarns disposed between said upper and lower CMD yarns, said CMD yarns interwoven with a system of machine direction (MD) yarns including an upper subsystem of MD yarns which do not weave with said lower CMD yarns, a lower subsystem of MD yarns which do not weave with said upper CMD yarns, an intermediate subsystem of MD yarns which weave exclusively with said intermediate CMD yarns such that removal of said CMD yarns permits a separation of the woven belt into upper and lower fabric portions, each end of said corrugator belt having said intermediate CMD yarns removed for a selected distance from the respective end and having said intermediate MD yarns trimmed back a selected distance from each end to thereby define a void between upper and lower end portions of the belt, a seam tape inserted in said void at each end of said belt, said seam tape having a series of seaming loops having a caliper greater than the caliper of said seam tape extending outwardly of a free edge thereof, means securing said seam tape within said void at each end of said fabric, and said upper and lower end portions on at least one end of said fabric having a beveled edge lying substantially flush with said seaming loops providing minimum interruption in the surface of the joint between said opposing ends of said fabric. In an alternate embodiment the corrugator belt fabric has a hooded seam to provide for uniform fabric surface across the hinge seam.

It is the object of the invention to provide a corrugator belt seam using high temperature resistant synthetic coils instead of metal hooks to eliminate the possibility of corrugator board marking and increase wear and stress resistance of the coils and joining wires.

A further object of the invention is to provide a corrugator belt with a smooth transition at the point of connection of the ends of the belt.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 2:
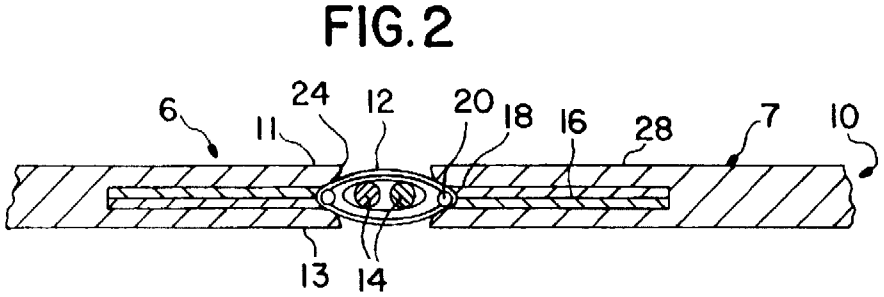
FIG. 2 is a longitudinal sectional elevation taken on the line 2—2 in FIG. 1.

The preferred embodiment will be described with reference to the drawing figures where like numbers represent like elements throughout.

Figure 1:
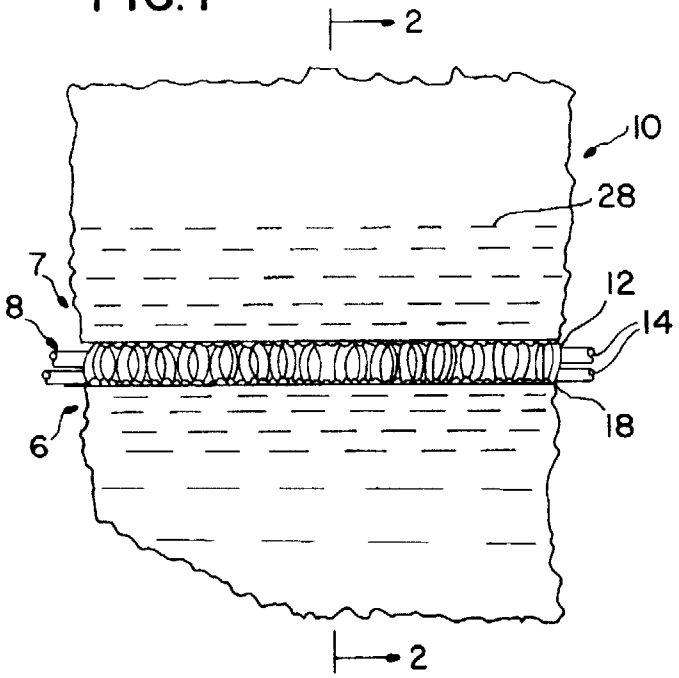
FIG. 1 is a elevated view illustrating a belt seam constructed in accordance with the present invention.

A corrugator belt seam 8 in accordance with the present invention is shown in FIG. 1. A corrugator fabric 10 with two ends 6 and 7 is joined by belt seam 8. Spiral coils 12 connect the opposite ends 6 and 7 of the fabric 10. The spiral coils 12 are secured together by pintles 14.

FIG. 2 illustrates a belt seam for the corrugator fabric 10 including separable upper and lower fabric portions 11 and 13 forming a terminal opening outwardly at free outer edges of the corrugator fabric 10. A seam tape 16 is sandwiched between the separated fabric portions 11 and 13 at each end of the corrugator fabric 10. A row of spiral coils 12 are carried by and extend outwardly of a free edge of the tape 16 on each end of the corrugator fabric 10. Stitching 28 secures the fabric portions 11 and 13 at each end of the corrugator fabric 10 to the respective seam tape 16 with the seam tape 16 between layers 11 and 13 at each end of the corrugator fabric 10.

Figure 3:
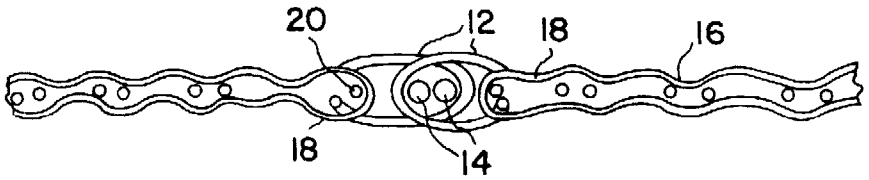
FIG. 3 is an enlarged longitudinal sectional elevation illustrating a belt seam constructed in accordance with the present invention.

By reference to FIG. 2, it will be noted that the outer ends of the separated warp layers 11 and 13 bevel inwardly toward the seam tape 16 formed by the inwardly beveled portions 24 from the spiral coils 12. Thus, there is no abrupt interruption in the surface of the joint caused by insertion of the seam tape 16. The seam tape 16 terminates at the open end of the fabric 10 with loops 18. The seam tape 16 is formed from a single ply woven tape which is folded upon itself which creates the loops 18 at the fold. As shown in FIG. 3, the loops 18 secure the spiral coils 12 to the seam tape 16. A bolt thread 20 is placed through the loops 18 and spiral coils 12 to further secure the coils 12 to the seam tape 16.

Figure 4A:
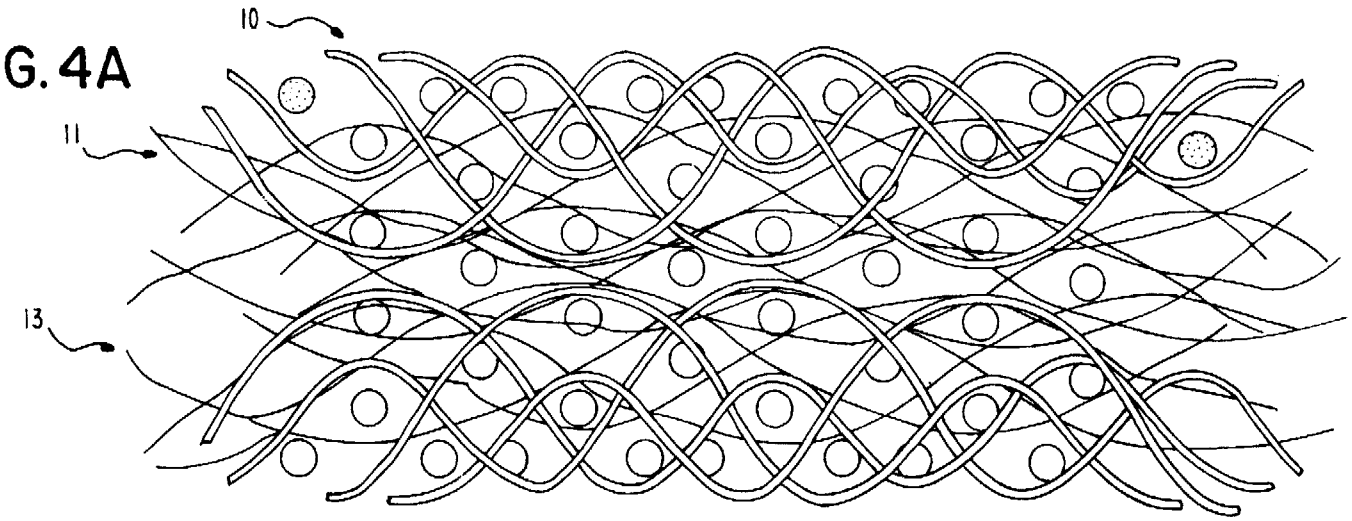
FIG. 4*a* is a schematic diagram of the weave structure of the corrugator belt.
Figure 4B:
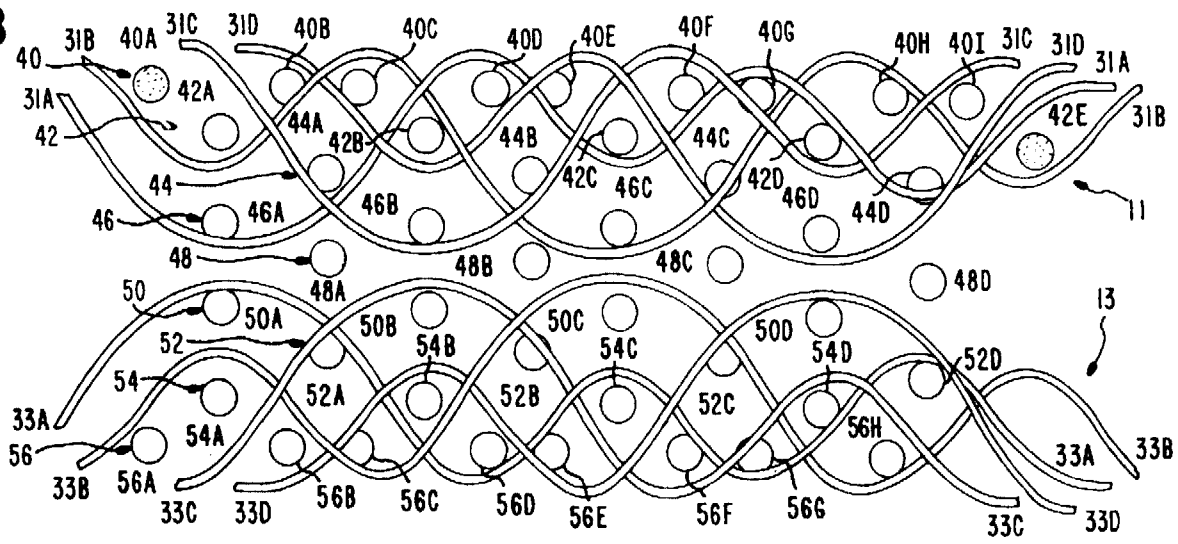
FIG. 4*b* is a schematic diagram of the two warp layer weave structure of the corrugator belt.

In manufacturing the corrugator fabric 10, a double beam loom, not shown, is set to weave fabric 10 having two systems of warp yarn with different crimp levels. The use of a double beam loom provides greater versatility than a single beam loom in the type of weave pattern chosen for the fabric 10 into which the tape 16/coil 12 assembly is inserted, by permitting the use of two systems of warp yarn with different crimp levels. The upper and lower fabric positions 11 and 13 permit removal of certain center CMD yarns which results in separation of the two warp layers. Consequently the different warps can interlace differently such that binder yarns in the center can be cut and certain filling yarns removed without sacrificing the integrity of the surface yarns on both sides in the seam area. FIGS. 4*a–b* illustrate a fabric 10 having upper and lower fabric positions 11 and 13. As shown in FIG. 4*d*, the fabric portions 11 and 13 are formed by severing center binder yarns 39A–D.

Figure 4C:
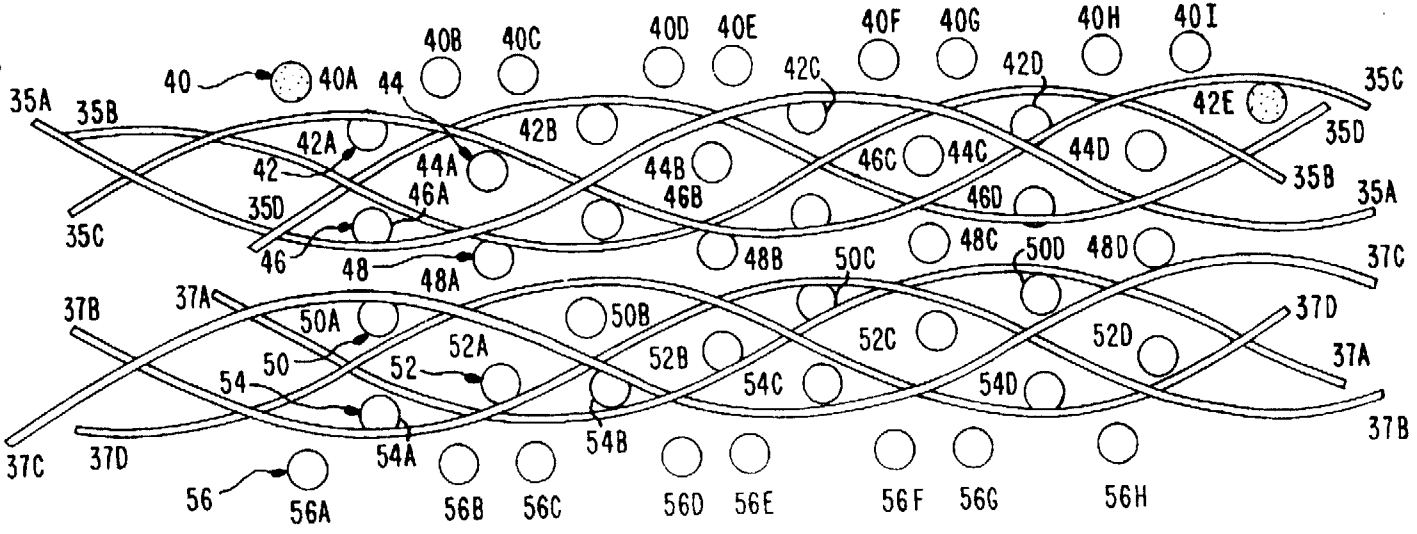
FIG. 4*c* is a schematic diagram of the two warp layer weave structure of the corrugator belt.
Figure 4D:
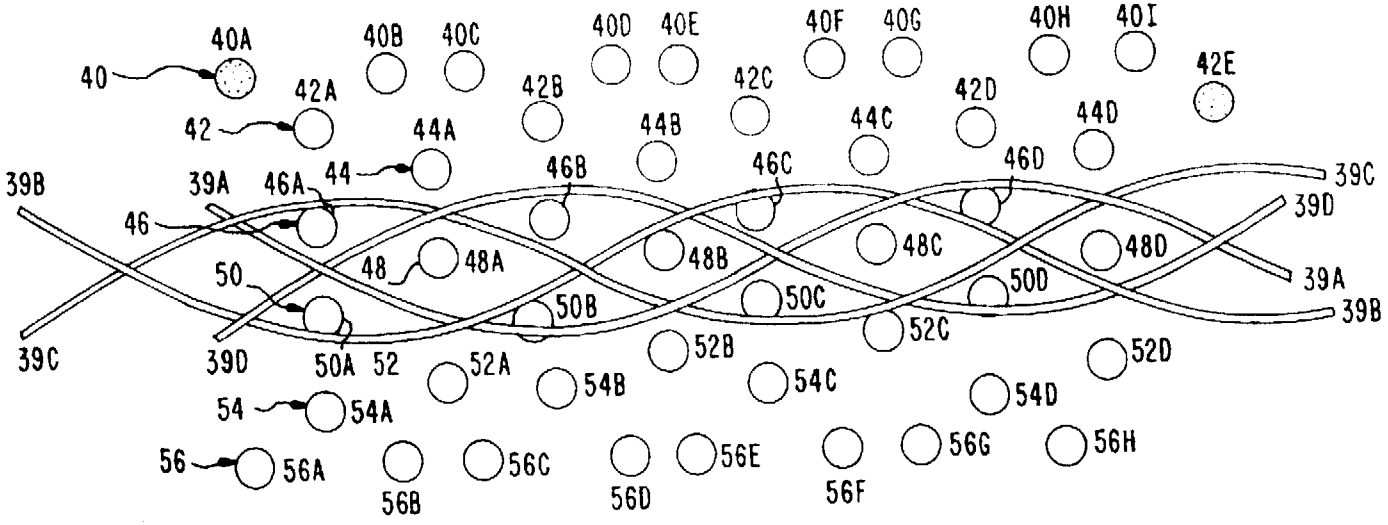
FIG. 4*d* is a schematic diagram of the center weave structure of the corrugator belt.

Referring to FIGS. 4*b–d*, there are shown the weave diagrams for the corrugated belt made in accordance with the teachings of the present invention. The belt comprises CMD yarns which make up upper filling layers 40, 42, 44, intermediate filling layers 46, 48, 50, and lower filling layers 52, 54, 56. The filling layers 40, 42, 44, 46, 50, 52, 54 and 56 are interwoven with upper warp yarns 31A–D and lower warp yarns 33A–D., as shown in FIG. 4*b*.

As further shown in FIG. 4*c*, upper warp yarns 35A–D and lower warp yarns 37A–D are interwoven with the filler CMD yarns 40, 42, 46, 48, 50, 52, 54 and 56. The upper filling layers 40, 42, 44 and upper warp yarns 31A–D and 35A–D comprise the upper fabric portion 11. The lower filling layers 52, 54, 55 and lower warp yarns 33A–D and 37A–D comprise the lower fabric portion 13.

As shown in FIG. 4*d*, intermediate warp yarns 39A–D interweave with intermediate filler CMD yarn layers 46, 48 and 50. The intermediate warp yarns 39A–D and the intermediate filler CMD yarns 46A–D, 48A–D and 50A–D can be removed without sacrificing the integrity of the surface yarns of the upper and lower fabric portions 11 and 13. Removal of the intermediate filler layers 46, 48, 50 and warp yarns 39A–D proximate the belt ends creates a void to permit the insertion of the seaming tape 16 without increasing the caliper of the belt at the seam area.

As shown in FIG. 4*b*, warp yarn 31A weaves under yarn 46A between yarns 44A and 48A between yarns 40C, 42B, between yarns 40B and 40E underneath yarn 42C, between yarns 40F and 40G, between yarns 42D and 40H, under yarn 44D and between yarns 40I and 42E.

As shown in FIG. 4*c*, warp yarn 35A interweaves under yarn 46A, between yarns 44A and 48A, between yarns 42B and 46B, between yarns 40D and 44B, over yarn 42C, between yarns 40F and 44C, between yarns 42D and 46D, and between 44D and 48D. As shown in FIG. 4*d*, center warp yarn 39A interweaves between 46A and 50A, under 50B, between 46C and 50C, over 46D and between 44D and 48D.

In manufacturing the belt seam 8 for the corrugator belt fabric 10, the fabric 10 is cut to a desired length determined by the size of the corrugator machine on which it is to be used. The ends of the fabric 10 are heat sealed to stabilize the filling yarn for handling. At least 1 inch of intermediate spun filling yarns 46A–D, 48A–D and 50A–D are removed on each end. The resulting loose warp yarns 39A–D are clipped. This procedure is repeated until the fabric layers are opened 3–4 inches from each end. The ends 6 and 7 of the fabric portions 11 and 13 are beveled (inside and outside) with a heat sealer. A light coat of polyurethane resin in a ¼ inch band is applied next to the inside bevel seals 24 on both fabric portions 11 and 13.

The seam tape 16 is formed from a full width piece of single ply tape, preferably 8 inches wide and having a 0.035–0.038 inches caliper which is folded upon itself. The folded edge is prepared for receiving a #50 PEEK (polyetheretherketone) coil 12 at 8 coils/inch with a 0.032 inches bolt thread 20 by removing filling yarns of the tape 16 to produce a sufficiently large void space. Preferably, the tape 16 is made from 100% monofilament yarns. Alternatively, the tape may have spun yarn for up to 50% of its CMD components, but the MD components are preferred to be monofilament. The tape 16 is folded around the coils 12 and the tape layers are sewn together immediately adjacent to the bolt thread 20 and again at 1 inch from the bolt thread 20. One layer of the tape 16 is marked with a scribe at 2¾ inches from the bolt thread 20 on the pick line of the tape 16 and the tape 16 is cut at this mark. The other layer of tape is to be marked and cut at 1¾ inches from the bolt thread. The tape 16 and coil 12 assembly is inserted between the fabric layers and stapled together, such that the end of the layers coincide with the bolt thread 20. Each end is sewed with six rows of white #207 Nomex yarn at 8.5 stitches per inch 28, such that the stitch points are embedded between the spun yarns on both surfaces. One additional row of sewing 28 is installed between the end of the tape 16 and the end of the open space between the fabric layers 11 and 13. This insures that any portion of opened fabric layers without tape 16 will remain as tight as the portion with tape 16. Edge reinforcement sewing is installed for 2 inches at each edge. If it is deemed necessary in certain cases, both ends 6 and 7 of the fabric 10 may be pressed at 200 psi and 350° F. such that the seam is approximately equal in thickness to the fabric 10. The first three sewings 28 closest to the coil on each end are then coated with a light coat of a resin such as Hexcel 3150 polyurethane resin extending up to ⅛ inch on both sides of each sewing line. The resin is selected to be flexible, heat-resistant to withstand corrugator machine conditioning of 325°–350° F. and low enough in viscosity to penetrate the corrugator belt.

Figure 5:
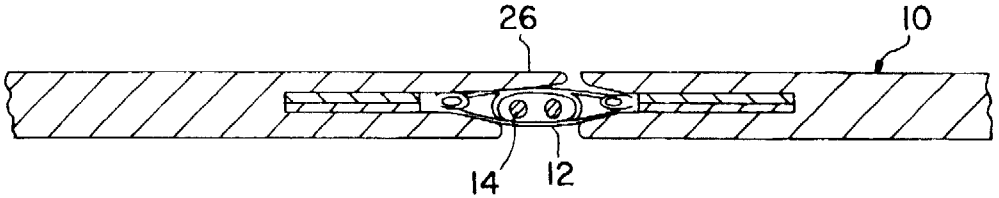
FIG. 5 is a longitudinal section of an alternate embodiment of the invention.

An alternate embodiment of the invention is shown in FIG. 5. The fabric 10 includes a hooded portion 26 which is an extension of the upper fabric portion 11. The hooded portion 26 is formed by cutting away the lower fabric end portion 13 such that the upper portion 11 projects a distance which equals the width of the seaming coils 12. The hood 26 covers the top surface of seam 8. The hooded portion 26 protects the seam 8 and provides a uniform surface for transfer of paper products. In the hooded embodiment, #33 PEEK coil yarns are preferred for coils 12.

While the present invention has been described in terms of the preferred embodiment, other variations which are within the scope of the invention as outlined in the claims below will be apparent to those skilled in the art.

What is claimed is:

1. A woven corrugator belt having a seam for joining opposing ends of the corrugator belt comprising:

a multi-layer system of cross machine direction (CMD) yarns including upper CMD yarns, lower CMD yarns and intermediate CMD yarns disposed between said upper and lower CMD yarns;

said CMD yarns interwoven with a system of machine direction (MD) yarns including:

an upper subsystem of MD yarns which do not weave with said lower CMD yarns, a lower subsystem of MD yarns which do not weave with said upper CMD yarns, and an intermediate subsystem of MD yarns which weave exclusively with said intermediate CMD yarns such that removal of said CMD yarns permits a separation of the woven belt into upper and lower fabric portions;

each end of said corrugator belt having said intermediate CMD yarns removed for a selected distance from the respective end and having said intermediate MD yarns trimmed back a selected distance from each end to thereby define a void between upper and lower end portions of the belt;

a seam tape inserted in said void at each end of said belt, said seam tape having a series of seaming loops having a caliper greater than the caliper of said seam tape extending outwardly of a free edge thereof;

means securing said seam tape within said void at each end of said fabric; and said upper and lower end portions on at least one end of said fabric having a beveled edge lying substantially flush with said seaming loops providing minimum interruption in the surface of the joint between said opposing ends of said fabric.

2. A corrugator belt according to claim 1 wherein said seam tape has a caliper in the range of 0.035 to 0.038 inches.

3. A corrugator belt according to claim 1 wherein said beveled end portion edges are coated with a polyurethane resin.

4. A corrugator belt according to claim 1 wherein said seaming tape comprises a single ply woven tape folded upon itself and said seaming loops being formed by a coil inserted into the fold of the tape.

5. A corrugator belt according to claim 4 wherein said coil is comprised of polyetheretherketone coil yarns.

6. A corrugator belt according to claim 1 wherein said upper and lower end portions of both ends of said fabric have beveled edges lying substantially flush with said seaming loops providing minimum interruption in the surface of the joint between said opposing ends of said fabric.

7. A corrugator belt according to claim 1 wherein said upper end portion on one end of said fabric extends to entirely cover said seaming loops.

8. A corrugator belt according to claim 1 wherein said seaming loops of said respective ends of said belt are intermeshed and at least one pintle yarn is inserted into the intermeshed loops to thereby seam the fabric ends together.

9. A method for making a seam for a woven corrugator belt having multiple layers of cross machine direction (CMD) yarns including upper CMD yarns, lower CMD yarns and a plurality of layers of intermediate CMD yarns disposed between said upper and lower CMD yarns interwoven with at least upper and lower machine direction (MD) yarns such that the upper MD yarns do not interweave with the lower CMD yarns and the lower MD yarns do not interweave with the upper CMD yarns, comprising the steps of:

removing intermediate CMD yarns for a selected distance from each end of the belt to permit separation of the woven belt into upper and lower fabric end portions;

inserting a seam tape between said separated upper and lower fabric end portions, said seam tape having a series of seaming loops extending outwardly of a free edge thereof;

securing said seam tape between said separated upper and lower fabric end portions; and finishing said upper and lower end portions on at least one end of said fabric to define a beveled edge lying substantially flush with said seaming loops to provide minimum interruption in the surface of the joint between said opposing ends of said belt.

10. The method of claim 9 further comprising intermeshing said seaming loops of said opposing ends of said belt and inserting at least one pintle yarn into said intermeshed loops to thereby seam the fabric ends together.

11. The method of claim 9 wherein said seaming tape is formed by folding a single ply tape upon itself and inserting a coil into the fold of the single ply tape to form said seaming loops.

* * * * *